US006259468B1

(12) United States Patent
Higuchi

(10) Patent No.: US 6,259,468 B1
(45) **Date of Patent: *Jul. 10, 2001**

(54) PRINTING APPARATUS WITH A PLURALITY OF PAPER FEEDING UNITS AND CONTROLS OF SAME

(75) Inventor: Yuichi Higuchi, Funabashi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/829,900

(22) Filed: Mar. 25, 1997

(30) Foreign Application Priority Data

Mar. 26, 1996 (JP) ..... 8-094707

(51) Int. Cl.[7] ..... B41J 2/435

(52) U.S. Cl. ..... 347/262; 347/101; 399/370; 358/449; 271/8.1

(58) Field of Search ..... 346/134; 347/101, 347/104, 106, 262; 399/45, 86, 16, 23, 367, 369, 370, 376, 389, 393, 392; 358/296, 300, 449, 498, 501–503; 400/582, 624; 101/228, 231; 271/8.1, 9.01–9.07, 9.09

(56) References Cited

U.S. PATENT DOCUMENTS

| | | | | |
|---|---|---|---|---|
| 4,763,889 | | 8/1988 | Dei et al. | 271/9.03 |
| 4,998,216 | * | 3/1991 | Hino et al. | 271/9.09 |
| 5,138,343 | * | 8/1992 | Aichi et al. | 347/29 |
| 5,258,779 | * | 11/1993 | Serizawa et al. | 346/134 |
| 5,278,622 | * | 1/1994 | Segawa | 399/371 |
| 5,420,669 | | 5/1995 | Imada | 399/16 |
| 5,488,407 | * | 1/1996 | Tachibana | 347/264 |
| 5,646,668 | * | 7/1997 | Fujioka et al. | 347/104 |

FOREIGN PATENT DOCUMENTS

| | | | |
|---|---|---|---|
| 0 562 735 | | 9/1993 | (EP) . |
| 3-213379 | | 9/1991 | (JP) . |
| 7187491 | * | 7/1995 | (JP) . |

OTHER PUBLICATIONS newton's Telecon Dictionary, pp. 652 and 653, Mar. 1998.*

* cited by examiner

*Primary Examiner*—Thinh Nguyen
*Assistant Examiner*—Shih-Wen Hsieh
(74) *Attorney, Agent, or Firm*—Fitzpatrick, Cella, Harper & Scinto

(57) ABSTRACT

In the case where since there is no recording paper in an upper stage cassette in which recording papers of an optimum size (for example, A4 size) should be enclosed, a lower stage cassette in which recording papers of another size are enclosed is used as a temporary paper feeding unit and a paper feed is performed, whether there is a status change such as supply of recording papers, removal of output papers from a paper ejecting unit, or the like or not is discriminated on the basis of a status change signal, whether the recording papers of the A4 size have been supplied to the upper stage cassette or not is discriminated, and whether an automatic paper feeding mode has been set or not is discriminated. Thus, when the recording papers of the A4 size are supplied to the upper stage cassette and the automatic paper feeding mode has been set, the paper feeding unit is switched from the lower stage cassette to the upper stage cassette.

53 Claims, 5 Drawing Sheets

| PAPER CASSETTE UNIT | RECORDING PAPER SIZE | PRESENCE OR ABSENCE OF PAPER | STATUS |
|---|---|---|---|
| 1008H (UPPER STAGE) | A4 | ABSENCE | WAITING |
| 1008M (INTERMEDIATE STAGE) | B4 | PRESENCE | WAITING |
| 1008L (LOWER STAGE) | B5 | PRESENCE | PRINTING |

PRINTING APPARATUS WITH A PLURALITY OF PAPER FEEDING UNITS AND CONTROLS OF SAME

BACKGROUND OF THE INVENTION

1. Field of the Invention

The invention relates to a printing apparatus having a plurality of paper feeding units, a printing method, and a printing system.

2. Related Background Art

Hitherto, a printing apparatus having a plurality of paper feeding units has been known. The printing apparatus generally has an automatic paper feeding mode and is constructed so that it can select a paper feeding unit for actually feeding papers for a printing process in accordance with a situation. For example, in case of printing print information received from a host computer, the paper feeding unit in which recording papers of the same size as a paper size that is decided by format information or the like have been enclosed is automatically selected. However, when the recording papers of the optimum size don't exist in any of the paper feeding units, the paper feeding unit in which the recording papers of the size that is nearer to the optimum size have been enclosed is selected or the paper feeding unit which has already been selected at the time of receipt of the print information is selected as it is.

The printing apparatus is also constructed in a manner such that even during a printing process by the paper feed of the selected paper feeding unit, recording papers can be ordinarily newly supplied to the other paper feeding units.

In the above printing apparatus, however, when the paper feeding unit is once selected and the printing process is started, since the paper feeding unit to feed the paper for the printing process has been fixed irrespective of the presence or absence of a change in status of the recording papers to be enclosed in the other paper feeding units, even if the recording papers of a more proper size are newly supplied to the other paper feeding unit, they cannot be soon used.

In the case where the recording papers of the size different from the recording paper size which has been preset as recording papers to be inherently enclosed in the other paper feeding unit are newly supplied to the relevant other paper feeding unit during the printing process and the operator is not aware of such a paper supply but forcedly selects such other paper feeding unit at the time of the next printing process or the like, there is a fear such that the printing process is performed by the recording paper of an improper size.

Further, when the output papers are removed from a paper ejecting unit by someone during the printing process and the operator is not aware of such a removal or the like, there is a fear such that all of the output papers cannot be certainly captured or it is necessary to again print.

SUMMARY OF THE INVENTION

The invention is made to solve the problems of the conventional techniques mentioned above and it is an object of the invention to provide a printing apparatus, a printing method, and a printing system which can perform a more proper printing process.

To accomplish the above object, according to the invention, there is provided a printing apparatus comprising: selecting means for selecting a paper feeding unit to actually perform a paper feed from a plurality of paper feeding units capable of feeding recording papers for a printing process; and processing means for executing a predetermined process on the basis of a change in statuses of recording papers in the paper feeding units other than the selected paper feeding unit which is caused by newly supplying recording papers to the other paper feeding units.

Preferably, the predetermined process is performed while the printing process is being executed by the paper feed of the paper feeding unit selected by the selecting means.

Preferably, the processing means further has switching means constructed in a manner such that when the recording papers of a more proper size upon execution of the printing process as compared with the recording papers in the selected paper feeding unit are newly supplied to any one of the other paper feeding units, the paper feeding unit to actually perform the paper feed is switched from the paper feeding unit selected by the selecting means to the paper feeding unit to which the recording papers of the more proper size were newly supplied.

More preferably, the printing apparatus further has inhibiting means for inhibiting the execution of the predetermined process.

More preferably, the processing means has size change notifying means constructed in a manner such that when the recording papers of a size different from the size of recording papers which has been preset as papers to be enclosed in the other paper feeding unit are newly supplied to the other paper feeding unit, such a fact is notified.

More preferably, the printing apparatus further has a paper ejecting unit for receiving output papers ejected as a result of the printing process and removal notifying means constructed in a manner such that when the output papers are removed from the paper ejecting unit, such a fact is notified.

To accomplish the above object, according to the invention, there is provided a printing method comprising: a selecting step of selecting a paper feeding unit to actually perform a paper feed from a plurality of paper feeding units capable of feeding recording papers for a printing process; and a processing step of executing a predetermined process on the basis of a change in statuses of recording papers in the paper feeding units other than the selected paper feeding unit which is caused by newly supplying recording papers to the other paper feeding units.

Preferably, the predetermined process is performed while the printing process is being executed by the paper feed of the paper feeding unit selected in the selecting step.

Preferably, the processing step further has a switching step constructed in a manner such that when the recording papers of a more proper size upon execution of the printing process as compared with the recording papers in the selected paper feeding unit are newly supplied to any one of the other paper feeding units, the paper feeding unit to actually perform the paper feed is switched from the paper feeding unit selected in the selecting step to the paper feeding unit to which the recording papers of the more proper size were newly supplied.

More preferably, the printing method further has an inhibiting step of inhibiting the execution of the predetermined process.

More preferably, the processing step has a size change notifying step constructed in a manner such that when the recording papers of a size different from the size of recording papers which has been preset as papers to be enclosed in the other paper feeding unit are newly supplied to the other paper feeding unit, such a fact is notified.

More preferably, the printing method further has a removal notifying step constructed in a manner such that when output papers are removed from a paper ejecting unit for receiving the output papers ejected as a result of the printing process, such a fact is notified.

To accomplish the above object, according to the invention, there is provided a printing system comprising: a host computer; printing means for printing data received from the host computer; selecting means for selecting a paper feeding unit to actually perform a paper feed from a plurality of paper feeding units capable of feeding recording papers for a printing process by the printing means; and processing means for performing a predetermined process on the basis of a change in statuses of the recording papers in the paper feeding units other than the selected paper feeding unit which is caused by newly supplying the recording papers to the other paper feeding units.

DETAILED DESCRIPTION OF THE PREFERRED EMBODIMENT

An embodiment of the invention will now be described hereinbelow with reference to the drawings.

Figure 1:
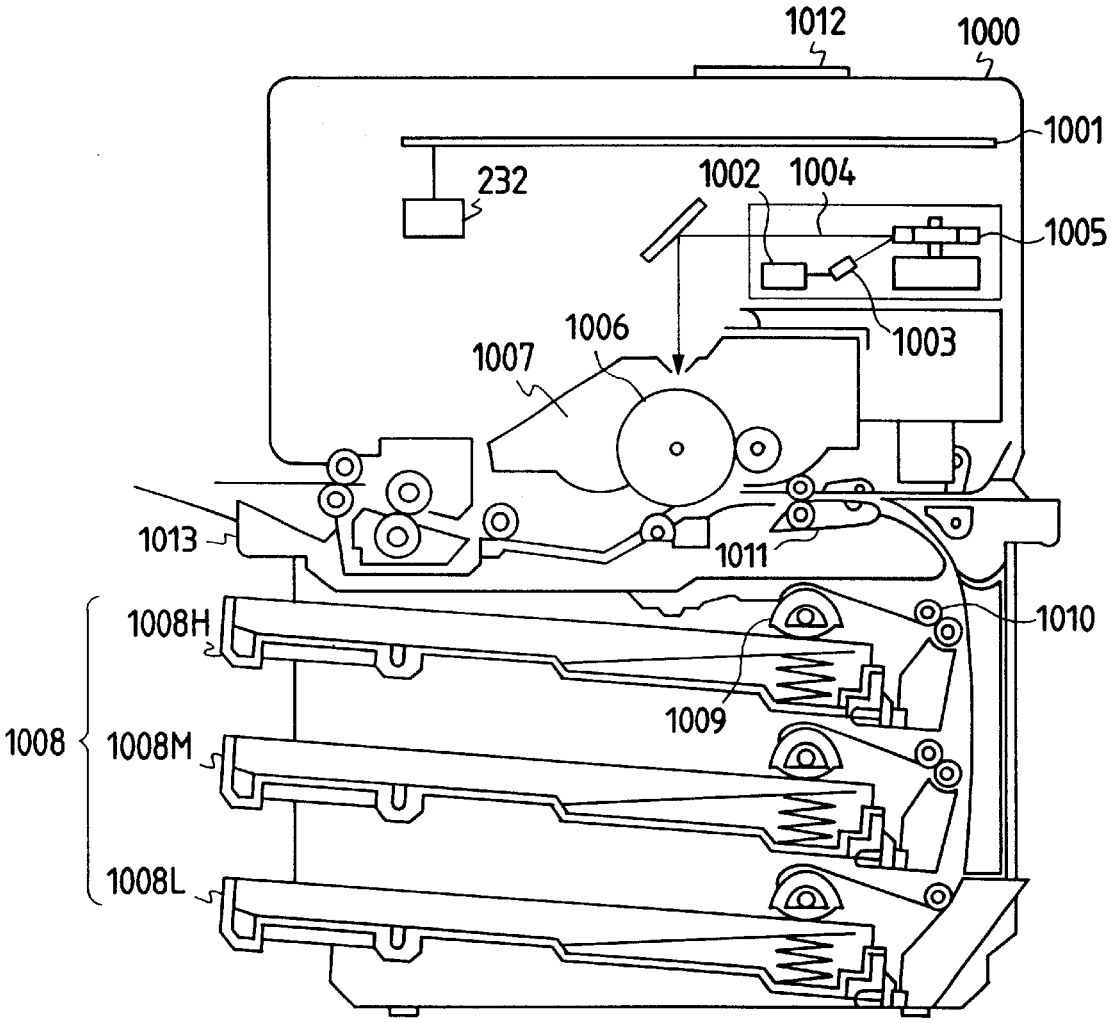
FIG. 1 is a cross sectional view showing a construction of a printing apparatus according to an embodiment of the invention.

FIG. 1 is a cross sectional view showing a construction of a printing apparatus according to the embodiment.

In the diagram, reference numeral 1000 denotes a laser beam printer as a printing apparatus which is connected to a host computer or the like (not shown) as an external data source. The laser beam printer 1000 is configured so that it can register a character pattern from the host computer or the like and can register a fixed format (form data) or the like. The laser beam printer 1000 is also constructed such that character information (or character code), form information, macro command information, and the like which are supplied from the host computer or the like are received and stored and a character pattern, a form pattern, or the like is formed in accordance with those information and an image is formed on a recording paper (not shown) as a recording medium.

Switches for various operations, a liquid crystal display device (LED), and the like are arranged on a console panel 1012. A printer control unit (hereinafter, referred to as a printer controller 1001) controls the whole laser beam printer 1000 and analyzes character information and the like which are supplied from an external computer or the like. The printer controller 1001 mainly converts the character information into a video signal of a character pattern corresponding thereto and generates the video signal to a laser driver 1002. The laser driver 1002 is a circuit to drive a semiconductor laser 1003 and on/off switches the emission of a laser beam 1004 by the semiconductor laser 1003 in accordance with the input video signal.

The laser beam 1004 is reflected to the right and left by a rotational polygon mirror 1005 and scans on an electrostatic drum 1006. Thus, an electrostatic latent image of the character pattern is formed on the electrostatic drum 1006. The electrostatic latent image is developed by a developing unit 1007 arranged around the electrostatic drum 1006 and, after that, it is transferred to a recording paper. For example, cut sheets are used as recording papers. Before recording, the recording papers have been set (hereinafter, referred to as "enclosed") in paper feeding units (hereinafter, referred to as a "paper cassette unit 1008") having a structure of three stages attached in the laser beam printer 1000.

The paper cassette unit 1008 is constructed by an upper stage cassette 1008H, an intermediate stage cassette 1008M, and a lower stage cassette 1008L. Each of the three paper cassettes can enclose the recording papers of a plurality of kinds of sizes. However, the recording papers of different predetermined sizes are generally enclosed.

The recording papers enclosed in the paper cassette unit 1008 are conveyed one by one upon recording by a paper feed roller 1009 and conveying rollers 1010 and 1011 and are supplied to the electrostatic drum 1006. The recording paper to which the electrostatic latent image was transferred is ejected as an output paper and is received into a paper ejecting unit 1013.

The printer controller 1001 is connected to an engine controller 232 so that various signals can be communicated.

Figure 2:
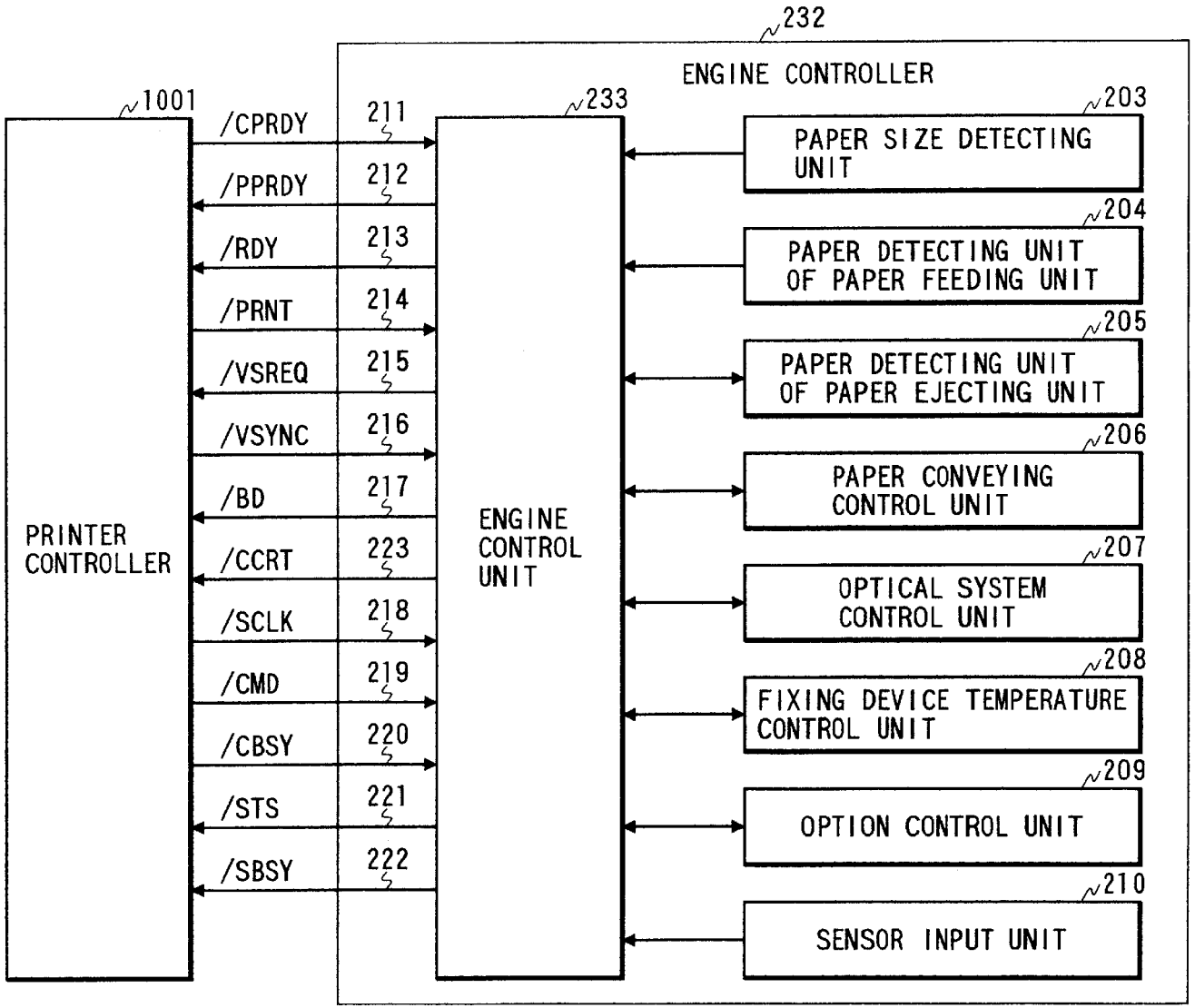
FIG. 2 is a block diagram showing a construction of a printer control unit in the printing apparatus.

FIG. 2 is a block diagram showing a construction of a printer control unit in the printing apparatus according to the embodiment. The printer control unit is constructed by the printer controller 1001 and engine controller 232. The engine controller 232 includes an engine control unit 233, a paper size detecting unit 203, a paper detecting unit 204 of a paper feeding unit, a paper detecting unit 205 of a paper ejecting unit, a paper conveying control unit 206, an optical system control unit 207, a fixing. device temperature control unit 208, an option control unit 209, and a sensor input unit 210.

The printer controller 1001 performs a communication with a host computer or the like, which will be explained hereinlater and a reception of image data from the host computer or the like. Further, the printer controller 1001 develops the received image data into printable information and performs a transmission and a reception and a serial communication of various signals to/from the engine control unit 233. The engine control unit 233 controls each unit of a printer engine, which will be explained hereinlater, through a transmission, a reception, and a serial communication of signals to/from the printer controller 1001.

The paper size detecting unit 203 detects a size of recording papers enclosed in the paper cassette unit 1008 and transmits detection information to the engine control unit 233. The paper detecting unit 204 of the paper feeding unit detects whether the recording papers have been enclosed or not with respect to each paper cassette unit 1008 and transmits detection information to the engine control unit 233. The paper detecting unit 204 of the paper feeding unit also detects the presence or absence of recording papers at each paper feeding slot of a manual inserting portion, an optional cassette, and a envelope feeder (which are not shown). The paper detecting unit 205 of the paper ejecting unit detects the presence or absence of the output papers in the paper ejecting unit 1013 to receive the output papers and transmits a detection signal to the engine control unit 233.

The paper conveying control unit 206 performs a control about the conveyance of the recording paper. The optical system control unit 207 executes a control regarding an optical system such as a scanner motor (not shown), laser beam 1004, or the like. The fixing device temperature control unit 208 performs a temperature control of a fixing device (not shown), an abnormality detection, and the like. The option control unit 209 executes an operating instruction to the optional cassette and envelope feeder (which are not shown). The sensor input unit 210 detects the presence or absence of the recording paper in a conveying path in each mode of a registration, a paper ejection, a both-side printing, a paper reversal, and the like.

The signal transmission and reception between the engine control unit 233 and printer controller 1001 will now be explained hereinbelow.

A /CPRDY signal 211 is a signal indicating that the printer controller 1001 is in a state in which it can communicate with the engine control unit 233 and is transmitted from the printer controller 1001 to the engine control unit 233. A /PPRDY signal 212 is a signal indicating that the engine control unit 233 is in a standby state in which it can communicate with the printer controller 1001 and is transmitted from the engine control unit 233 to the printer controller 1001.

A /RDY signal 213 is a signal indicating that the engine control unit 233 is in a standby state in which the printing operation can be performed and is transmitted from the engine control unit 233 to the printer controller 1001. A /PRNT signal 214 is a signal for the printer controller 1001 to generate a printing request to the engine control unit 233 and is transmitted from the printer controller 1001 to the engine control unit 233.

A /VSREQ signal 215 is a signal for the engine control unit 233 to request a vertical sync signal to the printer controller 1001 and is transmitted from the engine control unit 233 to the printer controller 1001. A /VSYNC signal 216 is a vertical sync signal for the printer controller 1001 to output to the engine control unit 233 and is transmitted from the printer controller 1001 to the engine control unit 233. A /BD signal 217 is a horizontal sync signal which is transmitted from the engine control unit 233 to the printer controller 1001.

A /CCRT (Condition Change Report) signal 223 is a signal constructed in a manner such that when the contents of statuses which are not directly concerned with the /RDY signal 213 among statuses of a printer engine 308, which will be explained hereinlater, change, the signal 223 is set to "TRUE", thereby informing the printer controller 1001 of a the change in status contents (hereinafter, referred to as a "status change"). The /CCRT signal 223 is transmitted from the engine control unit 233 to the printer controller 1001. As factors which cause such a status change, factors such that the recording papers have been supplied to the paper cassette unit 1008, the output papers in the paper ejecting unit 1013 have been removed, and the like can be mentioned.

A /SCLK signal 218 is a sync clock signal for serial communication and is transmitted from the printer controller 1001 to the engine control unit 233. A /CMD signal 219 is a signal for the printer controller 1001 to instruct a command to the engine control unit 233 and is transmitted from the printer controller 1001 to the engine control unit 233. A /CBSY signal 220 is a strobe signal to output a command and is transmitted from the printer controller 1001 to the engine control unit 233.

A /STS signal 221 is a signal indicative of a status such as a selection situation or the like of the paper cassette in the printer engine 308, which will be explained hereinafter, and is transmitted from the engine control unit 233 to the printer controller 1001 as an output in response to a command from the printer controller 1001. A /SBSY signal 222 is a signal for a status output and is transmitted from the engine control unit 233 to the printer controller 1001.

Figures 3, 4:
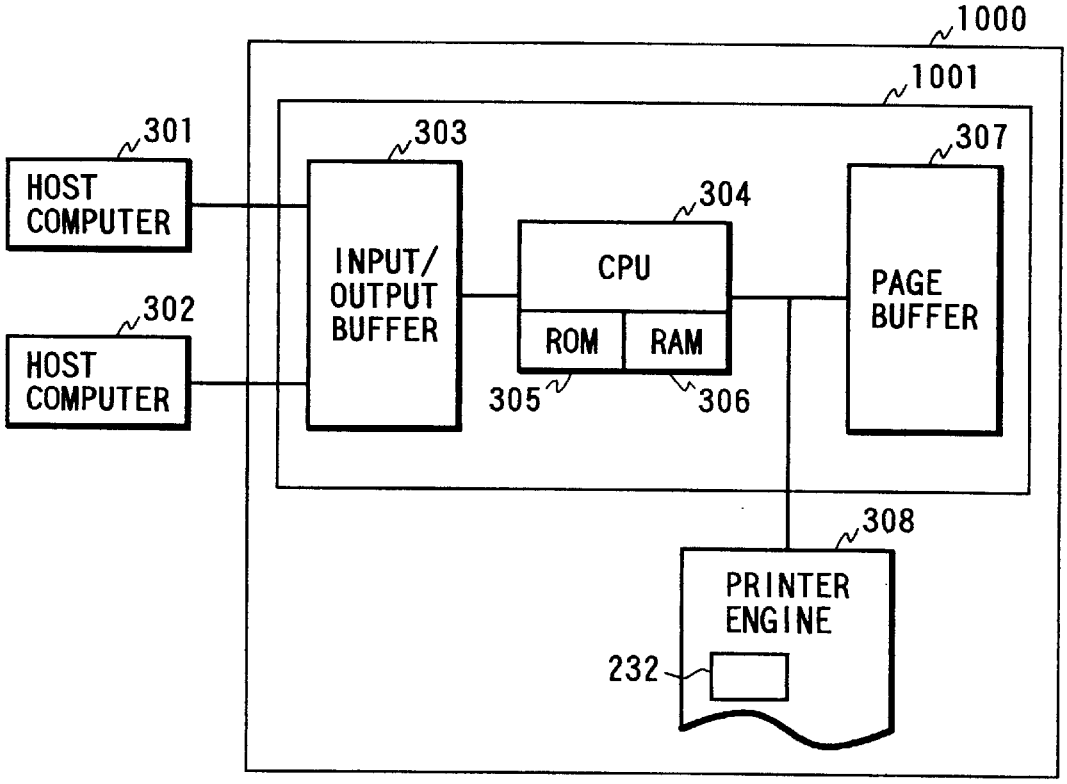
FIG. 3 is a block diagram showing a connecting relation between the printing apparatus and external apparatuses.
FIG. 4 is a diagram showing a concept of a storage area in an RAM of the printing apparatus.

FIG. 3 is a block diagram showing a connecting relation between the printing apparatus and the external apparatuses according to the embodiment.

Host computers 301 and 302 as external apparatuses are connected to the laser beam printer 1000 through ports (not shown). The host computers 301 and 302 function as data generating sources.

Although the laser beam printer 1000 is as described in FIG. 1, a portion in which the printer controller 1001 is removed from the laser beam printer 1000 corresponds to the printer engine 308. The printer engine 308 is a portion to actually print and includes the engine controller 232 mentioned above. The printer controller 1001 includes an input/output buffer 303, a CPU (central processing unit) 304, an ROM (read only memory) 305, an RAM (random access memory) 306, and a page buffer 307. The I/O buffer 303 and page buffer 307 are connected to a control block constructed by the CPU 304, ROM 305, and RAM 306. The printer engine 308 is connected to a connection line between the CPU 304 and page buffer 307.

The I/O buffer 303 temporarily stores data received from the host computers 301 and 302 through the ports and also temporarily stores data that is outputted to the host computers 301 and 302. The CPU 304 controls the printer controller 1001. A control program to be executed by the CPU 304, font patterns, and the like have been stored in the ROM 305. The RAM 306 is used as a work area of the CPU 304 and stores information indicative of the status of the paper cassette unit 1008 and the like. The page buffer 307 stores developed image data.

FIG. 4 is a diagram showing a concept of the storage area of the RAM 306. Status information about each of the upper, intermediate, and lower stage cassettes 1008H, 1008M, and 1008L is stored into a predetermined storage area in the RAM 306 as shown in the diagram. In the diagram, "recording paper size" is a size which has been preset as a size of recording papers to be enclosed in each paper cassette. "presence or absence of paper" indicates the presence or absence of the recording papers in each paper cassette. "status" indicates whether the paper cassette for printing is at present selected or not.

Among them, the information regarding the recording paper size is included in the /STS signal 221 and is transmitted from the engine control unit 233. The information about the presence or absence of the recording papers is transmitted from the paper detecting unit 204 of the paper feeding unit through the engine control unit 233. The information regarding the paper cassette selection is transmitted from the engine control unit 233.

It will be understood from FIG. 4 that, at present, there is no recording paper in the upper stage cassette 1008H corresponding to the A4-size and there are the recording papers in the intermediate stage cassette 1008M corresponding to the B4-size. There are the recording papers in the lower stage cassette 1008L corresponding to the B5-size. The lower stage cassette 1008L is at present selected as a paper cassette for actually feeding the papers for the printing process.

Figure 5:
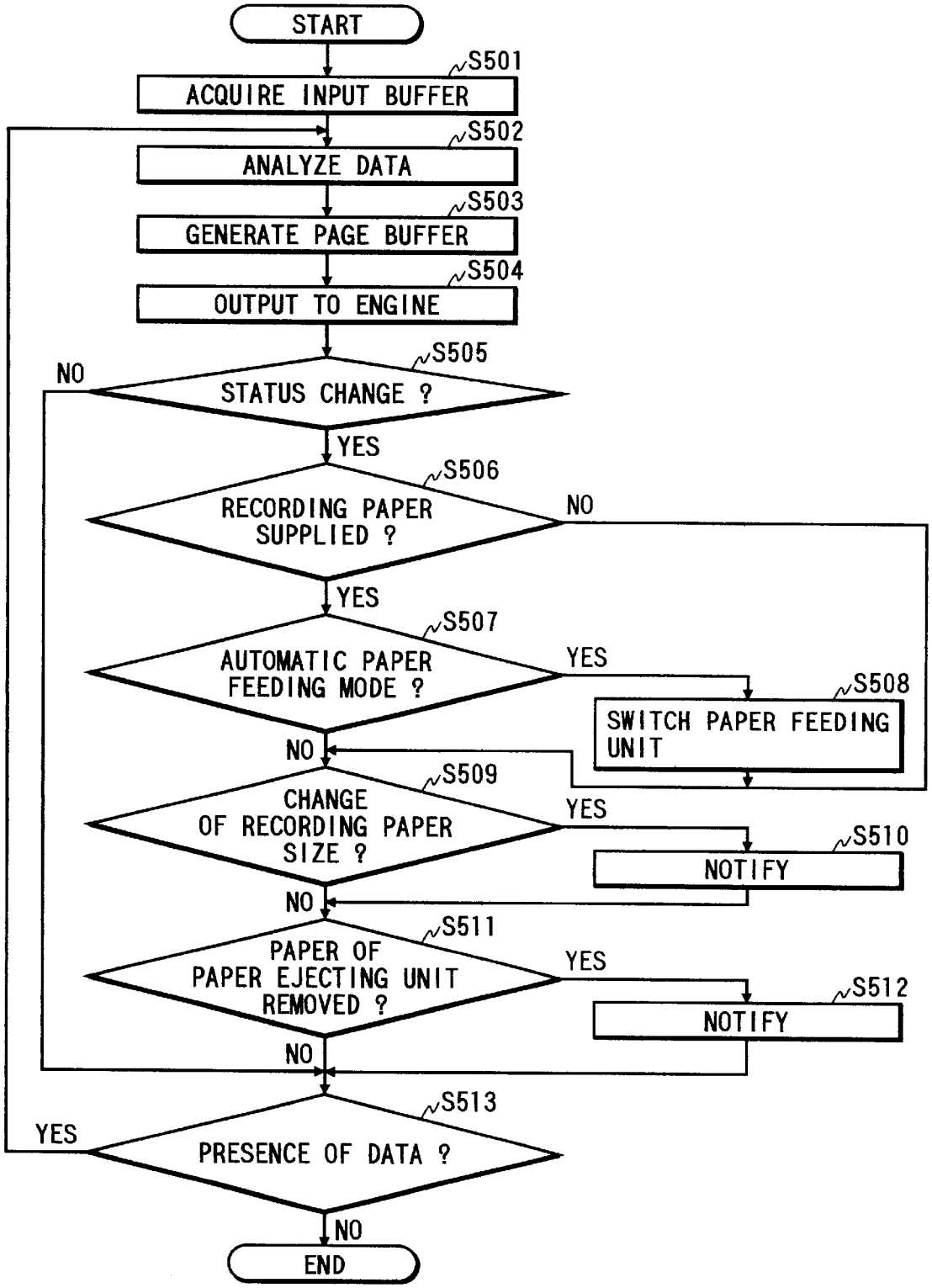
FIG. 5 is a flowchart showing a procedure of a printing process by the printing apparatus.

FIG. 5 is a flowchart showing a procedure of the printing process by the printing apparatus according to the embodiment.

A proper recording paper size to print the received data is determined by format information of a page in the form information received from the host computer 301 or the like. It is now assumed that the proper size is the A4 size. It is also assumed that when the data is received, the status of each paper cassette unit 1008 stored in the RAM 306 is as shown in FIG. 4.

In an automatic paper feeding mode, although the paper cassette adapted to the proper size is automatically selected from the paper cassette unit 1008, at the present time point, no recording paper is enclosed in the upper stage cassette 1008H of the adapted size. Therefore, the lower stage cassette 1008L which has been set before data reception is selected as a paper cassette to actually perform the paper feed. When the automatic paper feeding mode is not set, the lower stage cassette 1008L which has been set before data reception is selected as a paper cassette to actually feed the papers irrespective of the determined proper size.

When a power source is turned on, the present processing routine is started. When the data is received from the host computer 301 or 302 to the port, the CPU 304 allocates the I/O buffer 303 and stores the data into the I/O buffer 303 (step S501).

Subsequently, the CPU 304 analyzes the data stored in the I/O buffer 303 (step S502), forms a page buffer by developing the data into an image (step S503), and outputs the developed image to the printer engine 308 (step S504).

In step S505, the CPU 304 discriminates the presence or absence of a status change. Specifically speaking, when the /CCRT signal 223 that is transmitted from the engine control unit 233 is set to "TRUE", it is determined that there is a status change. When there is no status change as a result of the discrimination, step S513 follows and the CPU 304 discriminates whether the reception data still remains. If YES, the processing routine is returned to step S502. When no reception data remains, the processing routine is finished. That is, the paper feeding operation by the lower stage cassette 1008L is continued so long as there is no status change.

When the presence of the status change is decided in step S505, step S506 follows. On the basis of the detection signal from the paper detecting unit 204 of paper feeding unit, the CPU 304 discriminates whether the recording papers have been supplied or not to the paper cassette other than the paper cassette (lower stage cassette 1008L here) that is at present feeding the papers, namely, the paper cassette (upper stage cassette 1008H of the A4 size here) corresponding to the more proper size than the size of recording papers which have at present been supplied. When the recording papers of the more proper size are supplied, the CPU 304 discriminates whether the automatic paper feeding mode has been set or not (step S507).

Thus, only when the recording papers are supplied to the paper cassette of the more proper size and the automatic paper feeding mode has been set, the paper cassette to actually feed the papers is switched to the paper cassette to which the recording papers were supplied and such a fact is notified to the host computer (step S508). The processing routine advances to step S509. In the other cases, the processing routine immediately advances from step S506 or S507 to step S509 without switching the paper cassette.

In step S509, on the basis of the /STS signal 221 from the engine control unit 233, the CPU 304 discriminates whether there is a change in recording paper size in the paper cassettes other than the paper cassette which is at present feeding the papers, namely, whether the supply of the recording papers of a size different from the size of recording papers to be inherently enclosed or the like has been performed or not. Now, since the paper cassette that is at present in a paper feeding mode has already been switched to the upper stage cassette 1008H, on the basis of the detection signal of the paper site detecting unit 203, the CPU 304 discriminates whether the recording papers of the size (for instance, A3 size) different from the B5 size that has been preset in the other paper cassette, for example, the lower stage cassette 1008L have been supplied or the like to the lower stage cassette 1008L.

Figure 6:
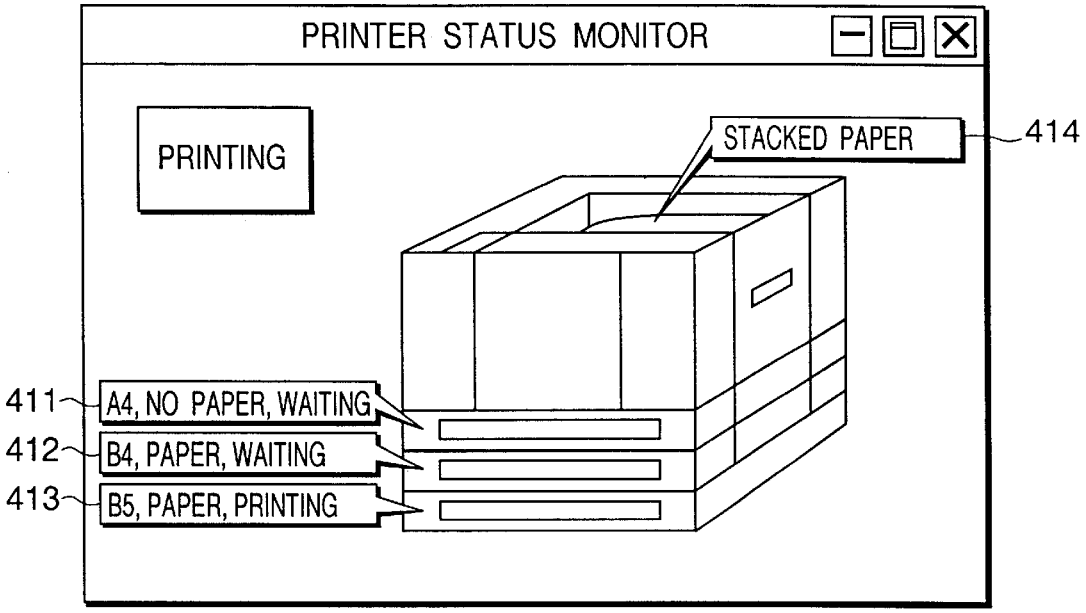
FIGS. 6 and 7 are diagrams showing examples of windows which are displayed on a display of a host computer.
Figure 7:
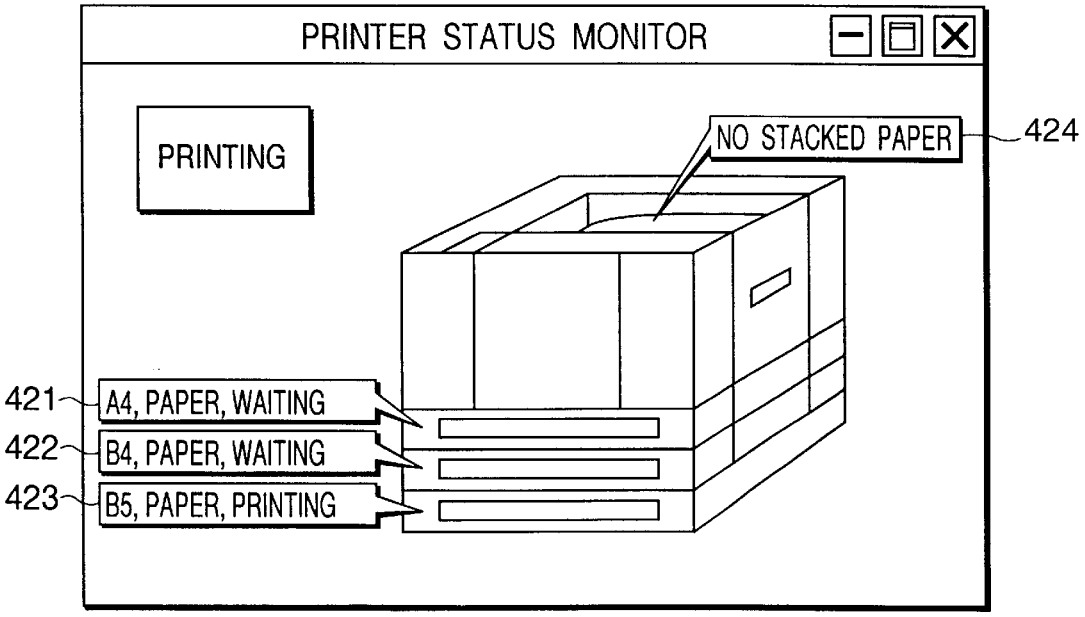

When it is determined that the supply or the like of the recording papers of the size different from the size of recording papers to be inherently enclosed have been performed, notification information of such a fact, namely, a fact indicating that the recording papers of the A3 size have been supplied to the lower stage cassette 1008L is written in the I/O buffer 303 and the written notification information is transmitted to the host computer 301 or the like (step S510). After that, step S511 follows. For instance, when a window of a status monitor as shown in FIG. 6 is displayed, the host computer responds to the receipt of the notification information and changes the monitor display to a display window as shown in FIG. 7. When the supply or the like of the recording papers of the different size is not performed in step S509, the processing routine immediately advances to step S511.

FIG. 6 is displayed when the status of FIG. 4 is notified to the host. Reference numeral 411 denotes an upper stage cassette unit, 412 an intermediate stage cassette unit, and 413 a lower stage cassette unit. In this case, the lower stage cassette is selected as a paper feeding unit. Reference numeral 414 indicates a status of a paper ejecting tray and shows that there are stacked papers at present.

FIG. 7 shows an example which is displayed to the host when a status change occurs. The papers have been supplied to the upper stage cassette and the papers of the intermediate stage cassette has been changed to the B5 size. All of the papers have been removed from a paper ejecting tray 424.

In step S511, on the basis of the detection signal of the paper detecting unit 205 of the paper ejecting unit, the CPU 304 discriminates whether the output papers received into the paper ejecting unit 1013 have been removed. If YES, notification information of such a fact is written into the I/O buffer 303 and the written notification information is transmitted to the host computer 301 or the like (step S512). After that, step S513 follows. When it is decided in step S511 that the output papers are not removed, the processing routine immediately advances to step S513.

By the present processing routine, when the recording paper size is changed in the paper cassettes other than the paper cassette that is in the paper feeding mode, such a fact is notified to the host computer 301 or the like. Therefore, a situation such that when the paper cassette in Which the size was changed is used in the next copying process, the print data is erroneously outputted to the recording papers of an improper size can be avoided.

Even when the output papers received in the paper ejecting unit 1013 are removed by someone, such a fact is notified to the host computer 301 or the like. Therefore, the output papers can be certainly obtained without losing.

Further, even when the automatic paper feeding mode is set and when the size of recording papers that are at present being fed is not the optimum size, if the recording papers of the more proper size are supplied to the other paper cassette, the paper feed is automatically switched to such a paper cassette. Thus, a more proper output result can be promptly and easily obtained.

By releasing the automatic paper feeding mode, the automatic switching of the paper cassette can be forcedly inhibited, so that a use efficiency can be improved.

A target to which the information regarding the change in recording paper size or the removal of the output papers from the paper ejecting unit is not limited to the host computer which transmitted the data but such a notification can be also performed to the other host computers.

The process to be executed in accordance with the status change is not limited to the notification or the like about the switching of the paper cassette or the change in paper size but another process can be also carried out. Further, as contents of "status change", other contents can be also properly set.

According to the invention as described above, the paper feeding unit to actually perform the paper feed is selected from a plurality of paper feeding units capable of feeding the recording papers for the printing process and the predetermined process is executed on the basis of the status change of the recording papers in the paper feeding units other than the selected paper feeding unit which is caused by newly supplying the recording papers to the other paper feeding units, so that the more proper printing process can be performed.

According to the invention, the predetermined process is executed while the printing process is being performed by the paper feed of the selected paper feeding unit, so that the proper printing process can be more promptly started.

According to the invention, since the paper feeding unit to actually perform the paper feed is switched from the selected paper feeding unit to the paper feeding unit to which the recording papers of the more proper size were supplied, the recording papers of the more proper size can be fed upon execution of the printing process.

According to the invention, since the execution of the predetermined process is inhibited, a use efficiency can be further improved.

According to the invention, when the recording papers of the size different from the size of recording papers which has been preset as a size of papers to be enclosed in the other paper feeding unit are newly supplied to the other paper feeding unit, such a fact is notified, so that a situation such that the print data is erroneously printed to the recording paper of an improper size can be avoided.

According to the invention, the output papers ejected as a result of the printing process are received and when the output papers are removed from the paper feeding unit, such a fact is notified, so that the output result can be more certainly obtained.

According to the invention, when the data received from the host computer is printed, the paper feeding unit to actually perform the paper feed is selected from the plurality of paper feeding units capable of feeding the recording papers for the printing process and the predetermined process is performed on the basis of the status change of the recording papers in the paper feeding units other than the selected paper feeding unit which is caused by newly supplying the recording papers to the other paper feeding units, so that the more proper printing process can be executed.

What is claimed is:

1. An apparatus comprising:

selecting means for selecting one of a plurality of paper feeding units feeding a recording paper for a printing process;

recognition means for recognizing, during a printing process on a recording paper fed by the selected paper feeding unit, a change in a status of at least one of the paper feeding units other than the selected paper feeding unit; and executing means for executing a predetermined process in accordance with the status change recognized by said recognition means, wherein said executing means has switching means that, when recording papers of a more proper size for execution of the printing process, as compared with a size of the recording papers in the selected paper feeding unit, are newly supplied to one of the other paper feeding units, switches the paper feeding unit to actually perform the paper feed from the selected paper feeding unit to the paper feeding unit to which the recording papers of the more proper size were newly supplied.

2. An apparatus according to claim 1, wherein said apparatus is operable in a mode of inhibiting said executing means from executing the predetermined process and a mode of allowing said executing means to execute the predetermined process.

3. An apparatus according to claim 1, further comprising means for converting print data from an external apparatus into pattern information for use in the printing process.

4. An apparatus according to claim 1, further comprising means for informing an external apparatus of the status change recognized by said recognition means.

5. An apparatus according to claim 1, further comprising means for printing an image during the printing process.

6. An apparatus according to claim 5, wherein said print means electrophotographically forms an image on the recording paper.

7. An apparatus comprising:

selecting means for selecting one of a plurality of paper feeding units feeding a recording paper for a printing process;

recognition means for recognizing, during a printing process on a recording paper fed by the selected paper feeding unit, a change in a status of at least one of the paper feeding units other than the selected paper feeding unit; and executing means for executing a predetermined process in accordance with the status change recognized by said recognition means, wherein said executing means has size change notifying means that notifies when recording papers of a size different from the size which has been preset to be enclosed in the paper feeding unit other than the selected paper feeding unit are newly supplied to the other paper feeding unit.

8. An apparatus according to claim 7, further comprising removal notifying means that when output papers are removed from a paper ejecting unit, such a fact is notified.

9. An apparatus according to claim 7, further comprising means for informing an external apparatus of the status change recognized by said recognition means.

10. An apparatus according to claim 7, further comprising means for converting print data from an external apparatus into pattern information for use in the printing process.

11. An apparatus according to claim 7, further comprising means for printing an image during the printing process.

12. An apparatus according to claim 11, wherein said print means electrophotographically forms an image on the recording paper.

13. A method comprising:

a selecting step of selecting one of a plurality of paper feeding units feeding a recording paper for a printing process;

a recognition step of recognizing, during a printing process on a recording paper fed by the selected paper feeding unit, a change in a status of at least one of the paper feeding units other than the selected paper feeding unit; and an executing step of executing a predetermined process in accordance with the status change recognized in said recognition step, wherein said executing step has a switching step that, when recording papers of a more proper size for execution of the printing process, as compared with a size of the recording papers in the selected paper feeding unit, are newly supplied to one of the other paper feeding units, switches the paper feeding unit to actually perform the paper feed from the paper feeding unit selected by said selecting means to the paper feeding unit to which the recording papers of the more proper size were newly supplied.

14. A method according to claim 13, wherein said method operates in a mode of inhibiting the executing of said predetermined process and a mode of allowing executing of the predetermined process.

15. A method according to claim 13, further comprising the step of converting print data from an external apparatus into pattern information for use in the printing process.

16. A method according to claim 13, further comprising the step of informing an external apparatus of the status change recognized in said recognizing step.

17. A method according to claim 13, further comprising the step of printing an image during the printing process.

18. A method according to claim 17, wherein said printing step electrophotographically forms an image on the recording paper.

19. A method comprising:

a selecting step of selecting one of a plurality of paper feeding units feeding a recording paper for a printing process;

a recognition step of recognizing, during a printing process on a recording paper fed by the selected paper feeding unit, a change in a status of at least one of the paper feeding units other than the selected paper feeding unit; and an executing step of executing a predetermined process in accordance with the status change recognized in said recognition step, wherein said executing step has a size change notifying step of nothing when recording papers of a size different from the size which has been preset to be enclosed in the paper feeding unit other than the selected paper feeding unit are newly supplied to the other paper feeding unit.

20. A method according to claim 19, further comprising:

a removal notifying step of notifying when output papers are removed from a paper ejecting unit for receiving the output papers ejected as a result of the printing process.

21. A method according to claim 19, further comprising the step of informing an external apparatus of the status change recognized in said recognizing step.

22. A method according to claim 19, further comprising the step of converting print data from an external apparatus into pattern information for use in the printing process.

23. A method according to claim 19, further comprising the step of printing an image during the printing process.

24. A method according to claim 23, wherein said printing step electrophotographically forms an image on the recording paper.

25. A system comprising:

a host computer; and an apparatus for receiving print data from said host computer, said apparatus comprising:

selecting means for selecting one of a plurality of paper feeding units feeding a recording paper for a printing process;

recognition means for recognizing, during a printing process on a recording paper fed by the selected paper feeding unit, a change in a status of at least one of the paper feeding units other than the selected paper feeding unit; and executing means for executing a predetermined process in accordance with the status change recognized by said recognition means, wherein said executing means has switching means that, when recording papers of a more proper size for execution of the printing process, as compared with a size of the recording papers in the selected paper feeding unit, are newly supplied to one of the other paper feeding units, switches the paper feeding unit to actually perform the paper feed from the said paper feeding unit selected by said selecting means to the paper feeding unit to which the recording papers of the said more proper size were newly supplied.

26. A system according to claim 25, wherein said apparatus is operable in a mode of inhibiting said executing means from executing the predetermined process and a mode of allowing said executing means to execute the predetermined process.

27. A system according to claim 25, wherein said apparatus further comprises means for converting the print data from said host computer into pattern information.

28. A system according to claim 25, wherein said apparatus further comprises means for informing said host computer of the status change recognized by said recognition means.

29. A system according to claim 25, wherein said apparatus further comprises means for printing an image during the printing process.

30. A system according to claim 29, wherein said print means electrophotographically forms an image on the recording paper.

31. A printing system comprising:

a host computer; and an apparatus for receiving print data from said host computer, said apparatus comprising:

selecting means for selecting one of a plurality of paper feeding units feeding a recording paper for a printing process;

recognition means for recognizing, during a printing process on a recording paper fed by the selected paper feeding unit, a change in a status of at least one of the paper feeding units other than the selected paper feeding unit; and executing means for executing a predetermined process in accordance with the status change recognized by said recognition means, wherein said executing means has size change notifying means that notifies a user when recording papers of a size different from the size which has been preset to be enclosed in the other paper feeding unit are newly supplied to the other paper feeding unit.

32. A system according to claim 31, wherein said apparatus further comprises removal notifying means that notifies a user when output papers are removed from a paper ejecting unit.

33. A system according to claim 31, further comprising means for informing said host computer of the status change recognized by said recognition means.

34. An apparatus according to claim 31, further comprising means for converting the print data from the host computer into pattern information.

35. An apparatus according to claim 31, further comprising means for printing an image during the printing process.

36. A printing system comprising:

a host computer;

a printer controller comprising:

means for receiving print data from said host computer;

means for detecting whether a printed paper is in a paper discharge unit in which at least one printed paper is placed after printing; and means for transmitting a detection result of said detection means to said host computer, wherein said host computer displays a status of the paper discharge unit, comprising information indicating whether a printed paper is in the paper discharge unit, based on the detection result of said detecting means;

recognition means for recognizing a change in a status of the paper discharge unit during the printing process; and means for informing said host computer of the status change recognized by said recognition means.

37. A printing system according to claim 36, wherein said host computer displays information indicating whether a print process is being performed, and wherein said host computer can update the information indicating whether a printed paper is in the paper discharge unit even when the print process is being performed.

38. A system according to claim 36, further comprising means for converting the print data from said host computer into pattern information.

39. A system according to claim 36, further comprising means for printing an image during the printing process.

40. A system according to claim 39, wherein said print means electrophotographically forms an image on the recording paper.

41. A printing system comprising:

a host computer; and a printer controller comprising:

means for receiving print data from said host computer;

means for detecting data relating to each of a plurality of paper feeding units from which at least one paper is supplied for printing; and means for transmitting a detection result of said detection means to said host computer, wherein said host computer displays a status of each of the plurality of paper feeding units based on the detection result of said detection means.

42. A printing system according to claim 41, wherein said host computer displays a paper size corresponding to each of the plurality of paper feeding units and information indicating whether a paper is in each of the plurality of paper feeding units.

43. A printing system according to claim 41, wherein said host computer displays a paper size corresponding to each of the plurality of paper feeding units, information indicating whether a paper is in each of the plurality of paper feeding units, and information indicating whether each of the plurality of paper feeding units is in use for printing.

44. A system according to claim 41, further comprising means for converting the print data from said host computer into pattern information.

45. A system according to claim 41, further comprising:

recognition means for recognizing, during a printing process on a recording paper fed by the selected paper feeding unit, a change in a status of at least one of the paper feeding units other than the selected paper feeding unit; and means for informing said host computer of the status change recognized by said recognition means.

46. A system according to claim 41, further comprising means for printing an image during the printing process.

47. A system according to claim 46, wherein said print means electrophotographically forms an image on the recording paper.

48. A method of controlling a host computer which sends print data to a printing apparatus, comprising:

a reception step of receiving, from the printing apparatus, a detection result indicating whether a printed paper is in a paper discharge unit in which at least one printed paper is placed after printing;

a display step of displaying information indicating whether a printed paper is in the paper discharge unit based on the detection result received in said reception step;

recognizing a change in a status of the paper discharge unit during the printing process; and informing the host computer of the recognized status change.

49. A method according to claim 48, wherein said display step further comprises displaying information indicating whether a print process is being performed, and wherein said display step can update the displaying of information indicating whether a printed paper is in the paper discharge unit even when the print process is being performed.

50. A method according to claim 49, wherein said display step displays the information graphically.

51. A method of controlling a host computer which sends print data to a printing apparatus, comprising:

a reception step of receiving, from the printing apparatus, data relating to each of a plurality of paper feeding units from which at least one paper is supplied for printing; and a display step of displaying a status of each of the plurality of paper feeding units based on the data received in said reception step.

52. A method according to claim 51, wherein said display step further comprising displaying a paper size corresponding to each of the plurality of paper feeding units and information indicating whether a paper is in each of the plurality of paper feeding units.

53. A method according to claim 51, wherein said display step further comprising displaying a paper size corresponding to each of the plurality of paper feeding units, information indicating whether a paper is in each of the plurality of paper feeding units, and information indicating whether each of the plurality of paper feeding units is in use for printing.

* * * * *

UNITED STATES PATENT AND TRADEMARK OFFICE

CERTIFICATE OF CORRECTION

PATENT NO. : 6,259,468 B1
DATED : July 10, 2001
INVENTOR(S) : Yuichi Higuchi

It is certified that error appears in the above-identified patent and that said Letters Patent is hereby corrected as shown below:

Title page,
Item [56] References Cited, OTHER PUBLICATIONS: "newton's" should read -- Newton's --.
Item [56] References Cited, Foreign Patent Documents: "7187491" should read -- 7-187491 --.

Column 3,
Line 49, "those" should read -- that --.

Column 8,
Line 52, "Which" should read -- which --.

Column 11,
Line 50, "of nothing" should read -- that notifies a user --.

Column 14,
Line 41, "claim 49," should read -- claim 48, --.
Line 53, "comprising" should read -- comprises --.
Line 58, "comprising" should read -- comprises --.

Signed and Sealed this

Fourteenth Day of May, 2002

*Attest:*

*Attesting Officer*

JAMES E. ROGAN
*Director of the United States Patent and Trademark Office*